United States Patent [19]

Kimura et al.

[11] Patent Number: 4,525,700

[45] Date of Patent: Jun. 25, 1985

[54] FIRE ALARM SYSTEM

[75] Inventors: Tetsuo Kimura, Tokyo; Seiichi Tanaka, Chiba; Takashi Suzuki, Tokyo, all of Japan

[73] Assignee: Nittan Company, Ltd., Tokyo, Japan

[21] Appl. No.: 546,108

[22] Filed: Oct. 27, 1983

[30] Foreign Application Priority Data

Oct. 27, 1982 [JP] Japan ..... 57-187495

[51] Int. Cl.[3] ..... G08B 26/00

[52] U.S. Cl. ..... 340/518; 340/505; 340/507; 340/511

[58] Field of Search ..... 340/518, 505, 506, 500, 340/508, 511, 510, 514, 522, 537, 825.06, 825.07, 825.08, 825.09, 825.1, 825.3, 825.54; 179/5 R

[56] References Cited

U.S. PATENT DOCUMENTS 4,100,542 7/1978 Gallant et al. ..... 340/518

4,222,041 9/1980 Von Tomkewitsch et al. ... 340/505

*Primary Examiner*—Donnie L. Crosland

*Attorney, Agent, or Firm*—Hill, Van Santen, Steadman & Simpson

[57] ABSTRACT

A fire alarm system has a main unit and a plurality of sensor terminals in accordance with a polling system. The plurality of sensor terminals are divided into a plurality of groups. When a given sensor terminal of a given group is accessed and transmits digital data as response data indicating a smoke concentration or a temperature to the main unit, and the response data exceeds a first reference value thereby indicating that a fire has broken out, the main unit accesses other sensor terminals of the given group. If some of the response data therefrom exceed a second reference value which is equal to or smaller than the first reference value, the main unit counts the number of such sensor terminals. When the number exceeds a predetermined number, the main unit displays information indicating the existence of a fire.

6 Claims, 5 Drawing Figures

FIRE ALARM SYSTEM

BACKGROUND OF THE INVENTION

The present invention relates to a fire alarm system and, more particularly, to a fire alarm polling system.

A conventional smoke sensor is operated when an analog sensor output corresponding to a smoke concentration exceeds a predetermined value. In a conventional fire alarm system, a plurality of smoke sensors of the type described above are separately connected to a transmission line. When any one of the smoke sensors detects a fire, this smoke sensor is operated to short circuit the transmission line, thereby signalling the existence of a fire to a main unit (central receiver) connected to the transmission line. However, the sensitivity of smoke sensors often varies, so that an erroneous alarm is generated or no alarm is generated. For example, even if an erroneous alarm or the like is prevented by logic ANDing or ORing the outputs from two smoke sensors, sufficient reliability cannot be obtained. Furthermore, in another conventional system, a sensor terminal does not determine whether or not a fire has broken out, but transmits to a main unit a digital signal obtained by converting an analog sensor output. The main unit compares the digital signal with a predetermined value so as to detect whether or not a fire has broken out. In this case, it is difficult for the main unit to perform detection in consideration of variations in the sensitivity of the smoke sensors.

SUMMARY OF THE INVENTION

It is an object of the present invention to eliminate the conventional drawbacks described above and to provide a highly reliable fire alarm system wherein an erroneous alarm and nonsignalling are prevented.

In order to achieve the above object of the present invention, there is provided a fire alarm system comprising a plurality of sensor terminals separately connected to a transmission line, each of the plurality of sensor terminals being arranged to transmit digital data as response data by converting an analog sensor output indicating one of the parameters smoke concentration and temperature when each sensor terminal is accessed by an address signal corresponding to an address of each sensor terminal. A main unit is connected to the plurality of sensor terminals through the transmission line. It cyclically accesses the plurality of sensor terminals and compares the response data from each sensor terminal with a first reference value. The plurality of sensor terminals are divided into a plurality of groups, and the main unit compares the response data from a given sensor terminal of a given group with the first reference value, and compares the response data from the other sensor terminals in the same group as the given sensor terminal, but excluding the given sensor terminal, with a second reference value which is smaller than the first reference value when the response data from the given sensor terminal exceeds the first reference value. The main unit determines that a fire has broken out when the number of sensor terminals supplying the response data exceeding the second reference value is greater than a predetermined number, and thereafter displays information indicating existence of a fire.

DETAILED DESCRIPTION OF THE PREFERRED EMBODIMENT

Figure 1:
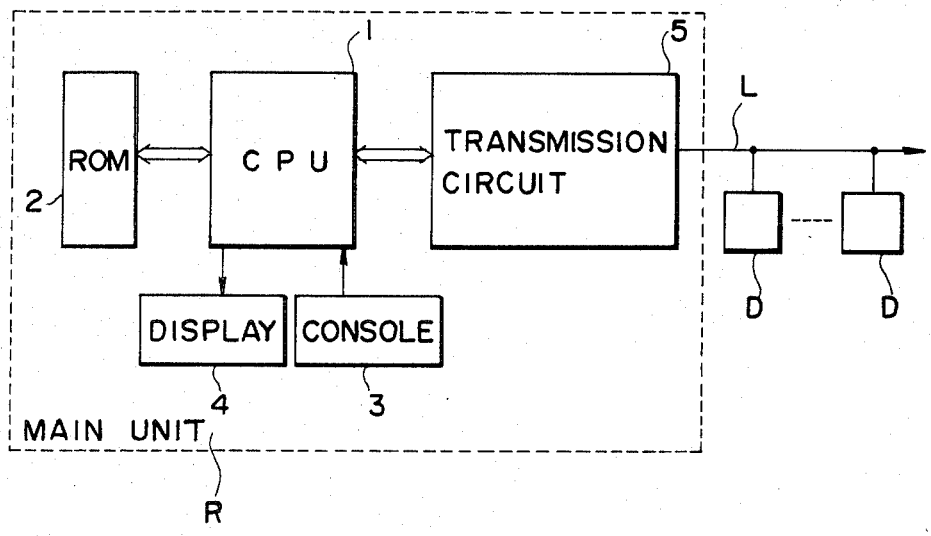
FIG. 1 is a block diagram of a fire alarm polling system to which the present invention is applied.

A fire alarm polling system according to an embodiment of the present invention will be described with reference to the accompanying drawings. FIG. 1 is a block diagram showing the overall configuration of a general fire alarm polling system. A plurality of sensor terminals D are separately connected to a transmission line L. Specific addresses are assigned to the sensor terminals D, respectively. A central processing unit (CPU) 1 is connected to the transmission line L through a transmission circuit 5. The CPU 1 cyclically accesses the sensor terminals D in response to address signals generated in accordance with a program stored in a read-only memory (ROM) 2. Each accessed sensor terminal D causes an A/D converter to convert an analog sensor output to a digital signal as response data. The response data is transmitted from this sensor terminal D to the CPU 1. The CPU 1 compares the response data with a predetermined value (reference value) and determines whether or not a fire has broken out. When the CPU 1 determines that a fire has broken out, the CPU 1 causes a display 4 to display information indicating the existence of a fire and to generate an audible alarm. Furthermore, the CPU 1 performs subsequent required operations. For example, the CPU 1 causes smoke exhaust equipment to start operation. The CPU 1 can access a specific sensor terminal upon entry of a command at a console 3 and can perform any other operation. However, it is impossible to identify variations in the sensitivity of the sensor terminals.

Figure 2:
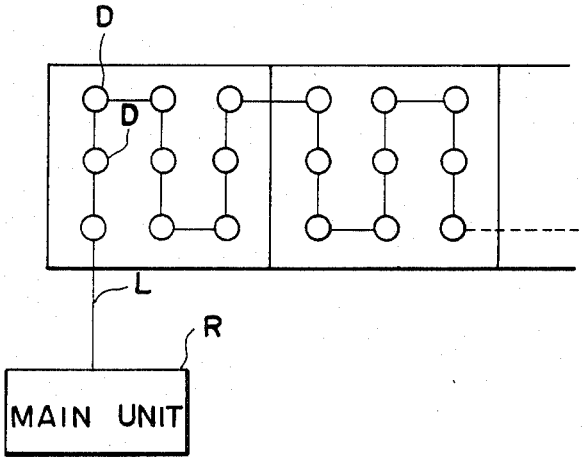
FIG. 2 is a representation showing how sensor terminals are grouped according to an embodiment of the present invention.

According to the present invention, the sensor terminals are divided into a plurality of groups. FIG. 2 shows the system configuration wherein nine sensor terminals D installed in the same room are included in one group. Grouping can be readily performed by a reference data table indicating a correspondence between a group number and addresses of the sensor terminals represented by this group number. The reference data table can be stored in the ROM 2. In this embodiment, in addition to a first reference value for indicating that a fire has broken out, a second reference value is also provided to indicate a prealarm level. During the period in which the sensor terminals D are cyclically accessed by the CPU 1 and the response data are compared with the first reference value, when the response data from a given sensor terminal D in a given group exceeds the first reference value, the CPU checks how many response data from the other sensor terminals in the given group exceed the second reference value. In this case, data of the number of sensor terminals supplying response data exceeding the second reference value can be prestored in the internal memory of the CPU 1 during each access operation of a terminal group. Alternatively, after a sensor terminal supplying response data exceeding the first reference value is detected, the other sensor terminals included in the same sensor terminal group can be reaccessed. These two selections may be determined in accordance with different program configurations. When the number of sensor terminals in the given group having response data exceeding the second reference value is greater than, for example, three, the CPU 1 determines that a fire has broken out and causes the display 4 to display fire indication information and generate an audible alarm.

Furthermore, operation of the smoke exhaust equipment is started. When a fire has actually broken out, the response data exceeding the second reference value is generally obtained from, for example, at least three terminals, even if variations in sensitivity of the sensor terminals are present. In practice, the second reference value is preset such that the response data exceeding the second reference level is obtained from at least three terminals. Even if one or more of the sensor terminals is malfunctioning, at least three sensor terminals will properly supply response data exceeding the second reference value, thereby preventing the system from nonsignalling. On the other hand, when the response data from only one of the sensor terminals exceeds the first reference value due to an abrupt or abnormal increase in temperature, the response data from any other sensor terminal included in the same group will not exceed the second reference value, thereby preventing the system from producing an erroneous alarm. However, the above-mentioned states must be displayed at the display 4 and must be stored in a memory such as a RAM in favor of maintenance and inspection guarantees. Furthermore, when data of the number of sensor terminals supplying response data exceeding the second reference value is stored in the memory, it can be utilized to properly reconsider the setting of the first reference value. In the above embodiment, the second reference value is a single predetermined value. However, a plurality of reference values may be used so as to corresopond to the respective terminal groups. In the above embodiment, the first reference value is greater than the second reference value. However, the first reference value may be equal to the second reference value.

According to the embodiment of the present invention, when a given sensor terminal of a given group supplies response data which exceeds the first reference value, the CPU checks how many other sensor terminals included in the given group supply response data exceeding the second reference value, thereby determining whether or not a fire has actually broken out. As a result, an erroneous alarm and nonsignalling can be prevented, so that a highly reliable fire alarm system can be obtained.

Figure 3A:
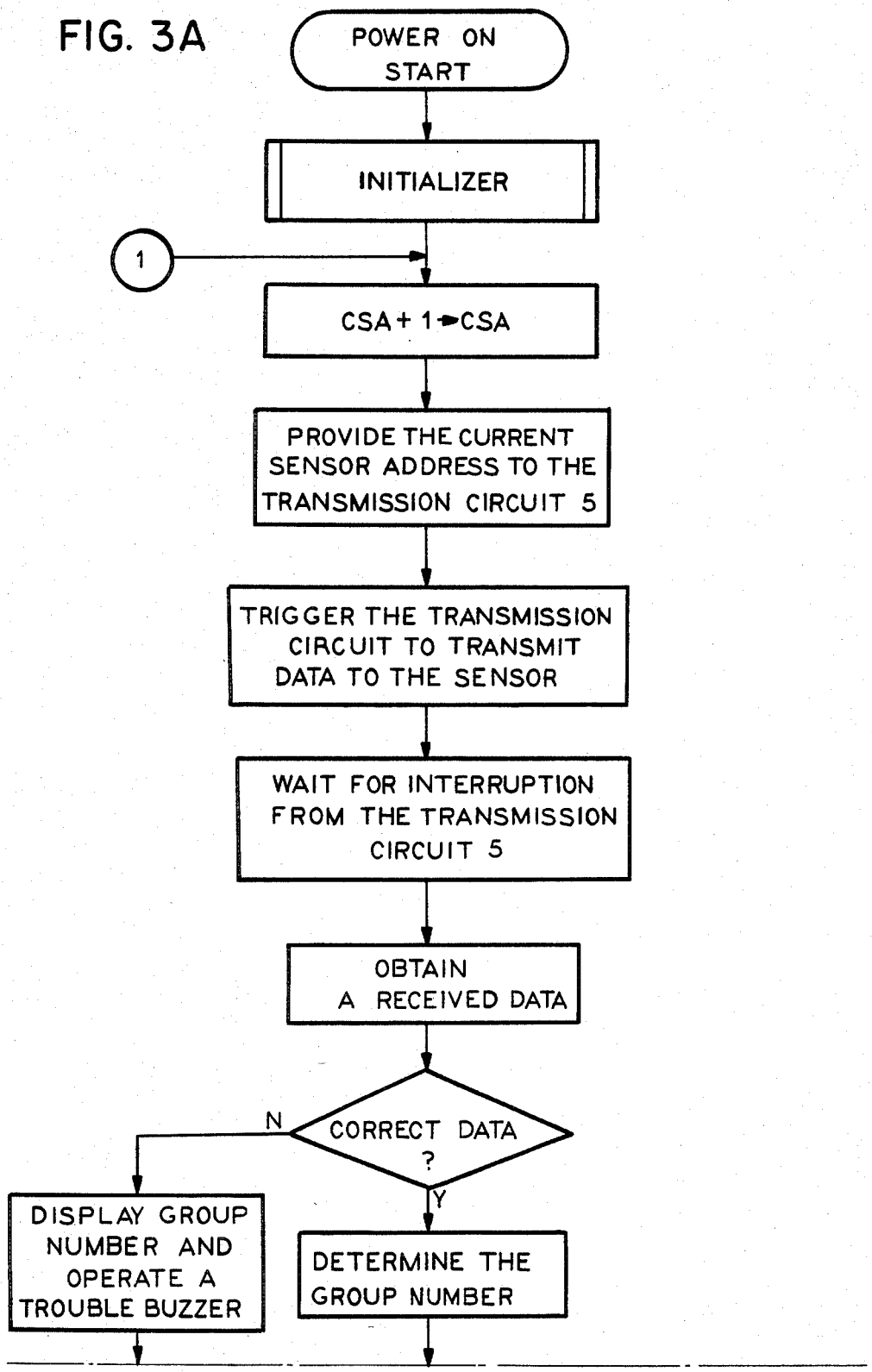
FIGS. 3A, 3B and 3C show a flow chart for a preferred embodiment of the invention.
Figure 3B:
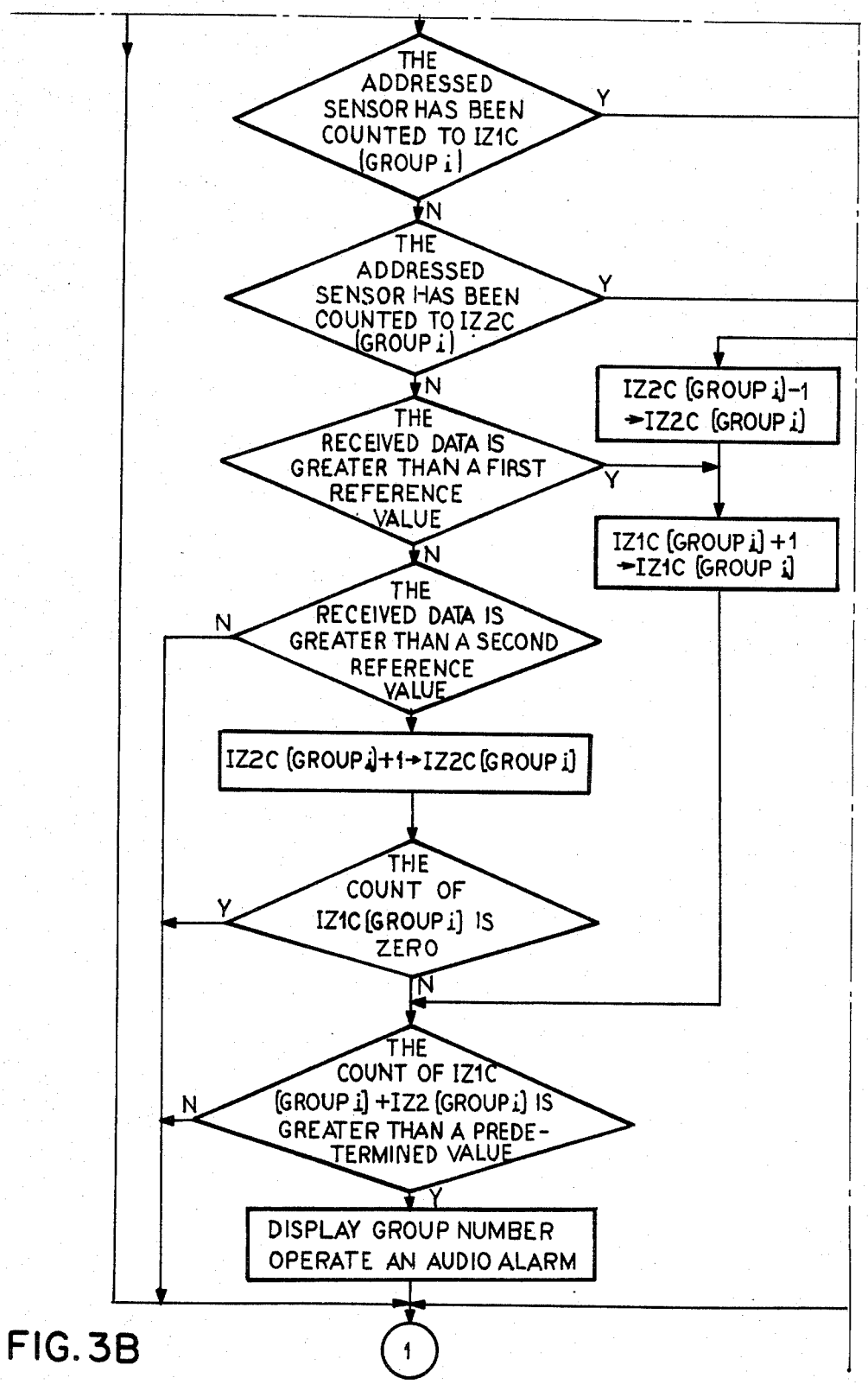
Figure 3C:
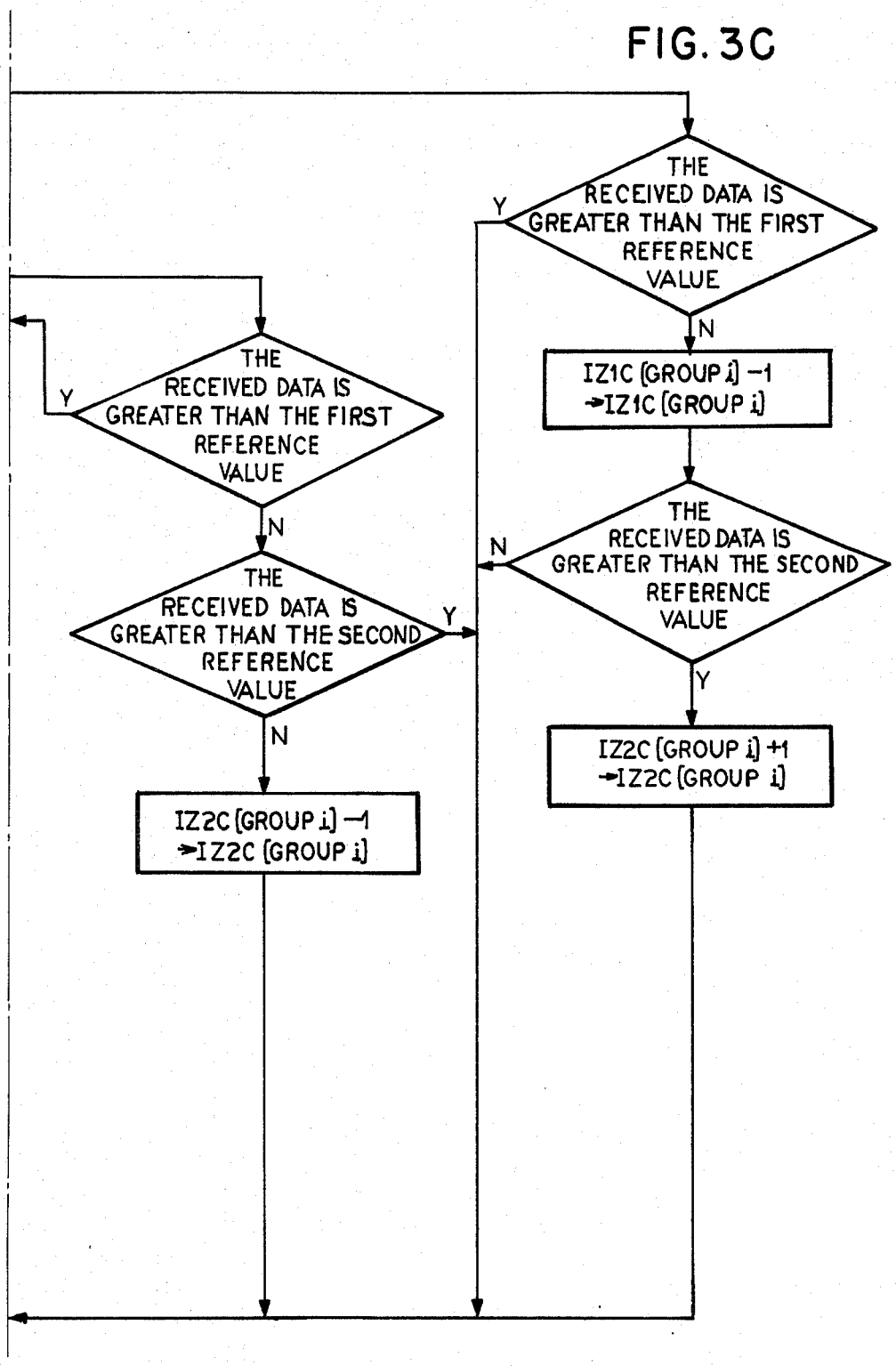

A flow chart shown in FIG. 3 is a preferred embodiment to practice this invention. When the system is supplied power, the CPU in the main unit R starts to execute a program. First the initializer subroutine is called. In this routine some buffers are set to given values and I/O interfaces for the transmission circuit 5 and console unit etc. are set for proper commands.

In a buffer CSA (current sensor address buffer) is stored current sensor addresses. Normally the buffer is counted up by one after processing a returned data so that the main unit cyclically addresses the sensor D and gathers analog data from the addressed sensor.

A content of the buffer CSA is renewed and transmitted to the transmission circuit 5. Since the CPU sends a trigger signal to the transmission circuit 5, the circuit automatically transmits an address signal and command signal (if required) to the sensor D which is assigned the address via the transmission line L. The CPU then waits for interruption from the circuit 5.

When the transmission circuit 5 has received a digitized analog data from the sensor 5, the circuit 5 sends an interruption signal to the CPU. The interruption waiting routine continuously checks an interruption flag. If it finds the flag, the CPU receives the digitized analog data with a stat bit, a parity bit and a stop bit from the circuit 5. The analog data processing is as described hereafter.

First of all these bits are examined to determine whether the communication between the main unit R and the sensor D has been accomplished successfully without any disturbance. If a failure is detected, the main unit R displays the address number on a trouble indicator and triggers a trouble buzzer. Otherwise, the CPU will find out a group number (Group i) to which the addressed sensor belongs. Two counters are provided i.e. IZ1C(Group i) and IZ2C(Group i). When an analog data is received which is greater than a first reference value a second reference value will be counted by these respective counters.

After finding a group number, the CPU examines whether the addressed sensor has already been counted to IZ1C(Group i) or IZ2C(Group i). In general, this examination is performed by checking a flag as to status of the sensor. When the counter is incremented the flag corresponding to the counter will be set, and when decremented the flag corresponding to the counter will be reset. After the examination, the digitized analog data is compared with the first and second reference values. There are nine cases to be considered. Each case is processed as follows:

Case 1—The addressed sensor has not been counted to any counters and the data is not greater than the second reference value—Return to Circle 1 .

Case 2—The addressed sensor has not been counted to any counters and the data is not greater than the first reference value but is greater than the second reference value. After incrementing of the counter IZ2C(Group i), the counter IZ1C(Group i) corresponding to the same group (i) is checked. If the counter is still zero, then return to 1 . If not, a summation of the counter IZ1C(Group i) and IZ2C(Group i) is compared with a predetermined value. In the case of a summation greater than the predetermined value, the control unit displays the group number i on an alarm indicator and triggers an audio alarm.

Case 3—The addressed sensor has not been counted to any counters and the data is greater than the first reference value. After incrementing the count of IZ1C(-Group i), a summation of the counts of IZ1C(Group i) and IZ2C(Group i) is compared with the predetermined value and a following process is the same as the corresponding portion of case 2.

Case 4—The addressed sensor has been counted to IZ2C(Group i) and the data is not greater than the second reference value. After decrementing the count of IZ2C(Group i), return to 1 .

Case 5—The addressed sensor has been counted to IZ2C (Group i) and the data is not greater than the first but is greater than the second reference values. Return to 1 .

Case 6—The addressed sensor has been counted to IZ2C(Group i) and the data is greater than the first reference value. After decrementing the count of IZ2C(Group i), a following process is exactly the same as Case 3.

Case 7—The addressed sensor has been counted to IZ1C(Group i) and the data is not greater than the second reference value. After decrementing the count of IZ1C(Group i), return to 1 .

Case 8—The addressed sensor has been counted to IZ1C(Group i) and the data is not greater than the first but is greater than the second reference value. After decrementing the count of IZ1C(Group i) and incrementing the count of IZ2C(Group i), return to 1 .

Case 9—The addressed sensor has been counted to IZ1C(Group i) and the data is greater than the first reference value. Return to 1 .

Although various minor changes and modifications might be proposed by those skilled in the art, it will be understood that we wish to include within the claims of the patent warranted hereon all such changes and modifications as reasonably come within our contribution to the art.

We claim as our invention:

1. A fire alarm system comprising:

a plurality of sensor terminal means separately connected to a transmission line, each of said plurality of sensor terminal means transmitting digital data as response data by converting an analog sensor output indicating one of the parameters smoke concentration and temperature when the respective sensor terminal means is accessed by an address signal corresponding to an address of the respective sensor terminal means;

a main unit means connected to said plurality of sensor terminal means through said transmission line for cyclically accessing said plurality of sensor terminal means and for comparing the response data from each sensor terminal means with a first reference value; and said plurality of sensor terminal means being divided into a plurality of groups, said main unit means comparing the response data from a given sensor terminal means of a given group with the first reference value and comparing the response data from the other sensor terminal means in the same group as the given sensor terminal means but excluding the given sensor terminal means with a second reference value when the response data from the given sensor terminal means exceeds the first reference value, and said main unit means determining that a fire has broken out when the number of sensor terminal means supplying response data exceeding the second reference value is greater than a predetermined number, and thereafter displaying information indicating existence of a fire.

2. A system according to claim 1 wherein the second reference value is smaller than the first reference value.

3. A system according to claim 1 wherein the sensor terminal means supplying the response data exceeding the second reference value are preset in a memory.

4. A system according to claim 1 wherein the sensor terminal means supplying the response data exceeding the second reference value are detected after the given sensor terminal in the same group which supplies the response data exceeding the first reference value is detected by said main unit means.

5. A system according to claim 1 wherein the first and second reference values are equal.

6. A fire alarm system comprising:

a plurality of sensor terminal means separately connected to a transmission line, each of the sensor terminal means transmitting digital data as response data indicative of presence of a fire when accessed by an address signal corresponding to an address of the respective sensor terminal means;

a main unit means connected to said plurality of sensor terminal means through the transmission line for repeatedly accessing the plurality of sensor terminal means and for comparing the response data from each sensor terminal means with a first reference value; and when said main unit means determines that response data from one of the sensor terminal means exceeds the first reference value, the main unit means then compares the response data from other sensor terminal means with a second reference value, and said main unit means then determining that a fire has broken out when the number of sensor terminal means supplying response data exceeding the second reference value is greater than a predetermined number, and thereafter supplying information indicating existence of a fire.

* * * * *